United States Patent [19]

Bolldorf et al.

[11] 4,444,133

[45] Apr. 24, 1984

[54] EMBROIDERING MACHINE HAVING COORDINATE MOVEMENT CONTROL FOR A WORK CARRIER WITH A DISENGAGEABLE CLUTCH

[75] Inventors: Kurt Bolldorf, Kaiserslautern; Gottfried Schmidt, Stebach, both of Fed. Rep. of Germany

[73] Assignee: Pfaff Industriemaschinen GmbH, Fed. Rep. of Germany

[21] Appl. No.: 490,353

[22] Filed: May 2, 1983

[30] Foreign Application Priority Data

May 13, 1982 [DE] Fed. Rep. of Germany ..... 3217962

[51] Int. Cl.[3] ..... D05C 9/02

[52] U.S. Cl. ..... 112/103

[58] Field of Search ..... 112/103, 102, 98, 86, 112/84, 119

[56] References Cited

U.S. PATENT DOCUMENTS 2,896,562 7/1959 Scheibel et al. ..... 112/103

3,482,536 12/1969 Hoever ..... 112/103

4,208,975 6/1980 Teetz ..... 112/103

*Primary Examiner*—H. Hampton Hunter

*Attorney, Agent, or Firm*—McGlew and Tuttle

[57] ABSTRACT

A multi-head embroidering machine comprises a work carrier to which movements relative to the embroidering heads and corresponding to the embroidery pattern are imparted by a coordinate control device. The work carrier is provided with guide rails which can be engaged directly, through a clutch mechanism, to the output sides of the coordinate control device. Each clutch mechanism comprises at least one guide roller which is connected to the output side of the coordinate control device, and a back-up roller which is mounted on a coupling lever, with the two rollers engaging the respective guide rail of the work carrier from opposite sides. This makes it possible to exchange a work carrier for a new one in standby position outside the embroidering machine, in a simple way and within a shortest time.

6 Claims, 4 Drawing Figures

EMBROIDERING MACHINE HAVING COORDINATE MOVEMENT CONTROL FOR A WORK CARRIER WITH A DISENGAGEABLE CLUTCH

FIELD AND BACKGROUND OF THE INVENTION

This invention relates in general to embroidering machines and to a new and useful mechanism for moving a workpiece carrier in respect to an embroidery head in respect to one or more coordinates which includes a disengageable clutch mechanism.

In multi-head embroidering machines, the material to be embroidered is clamped in circular or oval embroidery frames which are secured to a work carrier common to all the embroidery frames. To embroider borders, a frame encompassing all the embroidering heads and having no strutting in the embroidering area is employed instead of the circular or oval embroidery frames, or a plurality of embroidery frames is used extending over two or more embroidering heads.

Particularly if patterns with a small number of stitches are to be made, the embroidery frames must be exchanged for other frames, already prepared outside the machine, within relatively short periods of time, and each individual exchange frame must be secured to the work carrier separately, by means of knurled-head screws. The frequent exchange requires laborious finger work and time, and may quite considerably reduce the efficiency of the machine. A certain improvement has been obtained by substituting spring operated snap-action mechanisms for the screws (German Pat. No. 17 60 399 and German utility model 78 23 922), however, only small-size circular or oval embroidery frames can be secured in this way with a satisfactory reliablity. For clamping substantially larger border embroidery frames, the prior art snap mechanisms are unsuitable. Consequently, border embroidering frames have to be fixed to the driven work carriers, or to a carrier rail, by means of screws as before.

A prior art multi-head embroidering machine is disclosed in German AS 27 45 396, for example. In this design, the embroidery frames are exchangeably secured to a carrier rail which extends over all of the embroidery heads and is in turn firmly connected, through a plurality of struts, to a well known pantograph bar by which the embroidery frames are moved beneath the embroidering heads in accordance with the desired pattern, in the directions perpendicular to each other. On the underside of the pantograph bar, mutually perpendicular guide rails are provided which are received without play each between two ball bearings mounted on drive slides for rotation about fixed shafts forming the output sides of a coordinate control device. The pantograph bar has a hollow rectangular cross section, with a downwardly open slot therethrough. The lower horizontal legs engage the ball bearings from below and project into grooves of the drive slides. The pantograph bar forms a part of the coordinate control device and, as mentioned above, it is firmly connected to the rail carrying the embroidery frame, through a plurality of relatively long struts. This strutting of the pantograph bar to the carrier rail must be made relatively massive, thus the masses to be moved must be augmented, if a stability for high embroidering speeds and exactly made patterns is sought.

SUMMARY OF THE INVENTION

The invention is directed to an easily detachable connection between the work carrier and the output sides of the coordinate control device, while omitting intermediate struts and while minimizing the time necessary for exchanging the embroidery frames for frames prepared outside the machine.

The easily disengageable direct coupling of the work carrier to the outsides of the coordinate control device, saves time during the carrier exchange, the masses to be moved are reduced, and in addition, due to the inventive solution, the work carrier becomes less sensitive to vibrations so that higher embroider speeds can be provided while exact movements corresponding to the embroidery pattern are obtained with the correspondingly exact transformation of the impulses issuing from the stepping motors.

In accordance with the invention, an embroidering machine which has at least one or more embroidery heads includes a coordinate movement member which is connectable to a work carrier by a clutch mechanism which may be easily released or engaged. The clutch mechanism is carried on an endless gear belt which is driven by a separate stepping motor for each coordinate.

In a preferred arrangement, the work carrier includes a guide rail and the clutch mechanism has a stationary guide roller alongside which the rail is positioned and a clutching roller which is engaged by a clutch mechanism against the opposite side of the rail to hold the work carrier in a guiding position with the clutch mechanism which is movable by a movable coordinate positioning member. The inventive arrangement provides a satisfactory transmission for the control movements to the work carrier while ensuring an easy motion and an exact guidance. In accordance with a feature of the invention, the clutching mechanisms are positioned in respect to actuators which are moved for example by pressure or electrical controls to either latch or unlatch the work carrier from the clutch mechanism. This may be done by a simple actuation of the switch. The construction advantageously includes a coupling lever which is in alignment with an actuator which may be switched on to effect a desired coupling or uncoupling. Only a small force is needed for actuating the coupling lever and a satisfactory locking against unintentional disengagement of the coupling is obtained in a coupled position. The coupling motion of the coupling lever can easily be limited by stopped elements which are arranged in respect thereto.

Accordingly, it is an object of the invention to provide an improved coupling mechanism for coupling and uncoupling a work carrier to an apparatus for moving the carrier along a selected coordinate.

A further object of the invention is to provide an embroidering machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
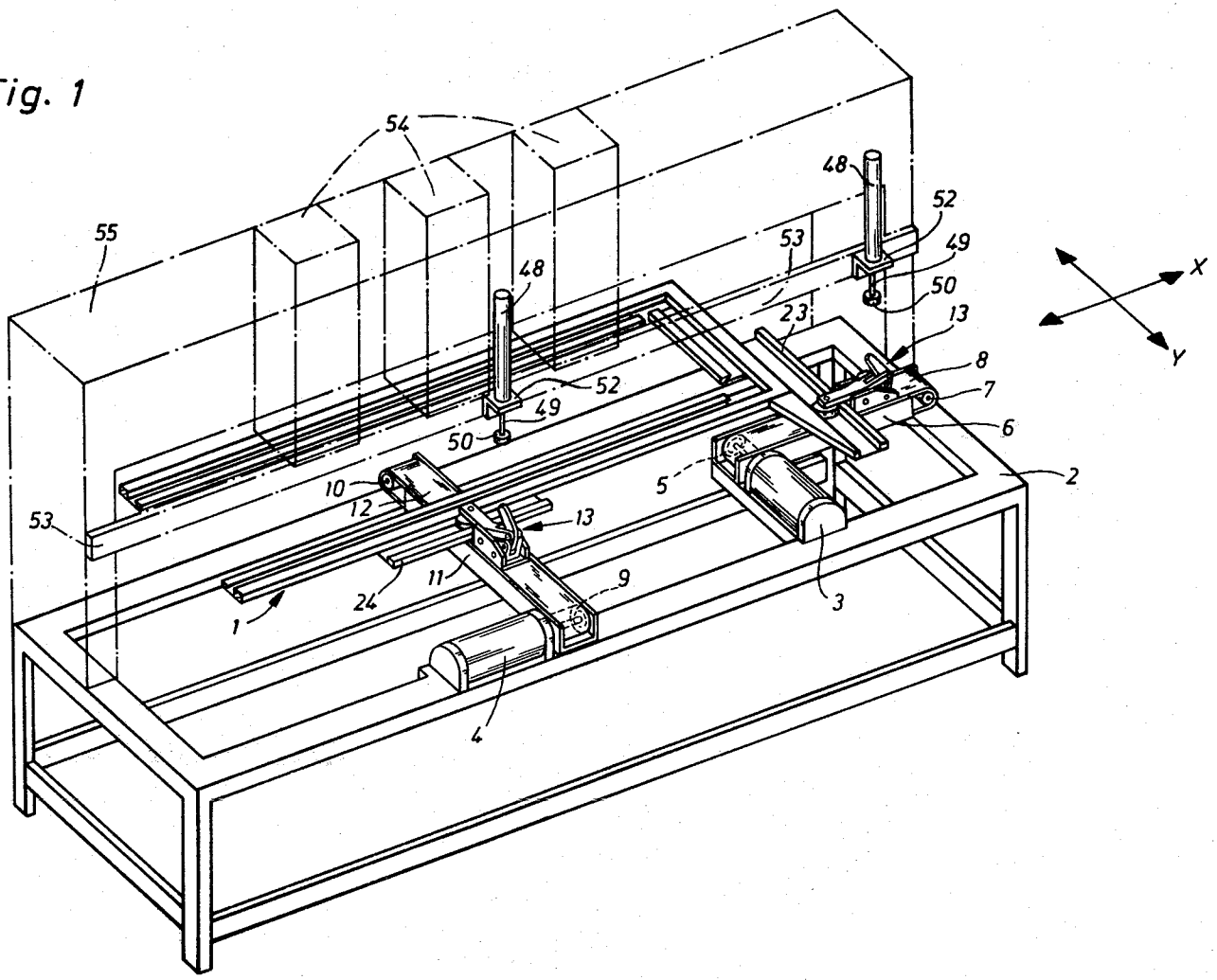
FIG. 1 is a simplified rear perspective view of a multi-head embroidery machine, constructed in accordance with the invention.

Referring to the drawings in particular the invention embodied therein comprises a workpiece moving device for an embroidering machine having at least one embroidery head and advantageously being a multi-head machine. The device comprises a work carrier generally designated 1 in FIG. 1 and one or more coordinate control mechanisms in the form of separate stepping motors which embodiment comprises a stepping motor 3 for the longitudinal movement and a stepping motor 4 for transverse movement. In accordance with the invention, stepping motor 3 includes a gear 5, stepping motor 4 includes a gear 9 which drive a gear belt 8 and 12 respectively which carry clutch mechanisms generally designated 13 which are engageable with the work carrier for shifting it along a selected coordinate, for example the x and y coordinates as indicated in FIG. 1. The clutch mechanism 13 includes engagement means which in the embodiment shown comprises rollers 21 and 25 which engage on respective opposite sides of a guide rail 23 of the work carrier 1, upon actuation of the clutch mechanism.

To the work carrier 1 shown in the present example as a border frame, movements perpendicular thereto (x,y FIG. 1) are imparted by two stepping motors 3,4 which are supported on the machine frame. These movements imparted to work carrier 1 correspond to the desired embroidery pattern which is stored in the form of control instructions on a punched card or tape and transmitted through an electronic control to stepping motors 3,4. The stepping motor 3 produces longitudinal movements and stepping motor 4 transverse movements of the work carrier 1. The rotary movements of stepping motor 3 in the two directions are transmitted by a gear 5 to an endless gear belt 8 which is trained on the other end around a return gear 7 mounted on an auxiliary frame 6 fixed to the housing. The rotary movements of the stepping motor 4 in the two directions are transmitted by a gear 9 to an endless gear belt 12 which is trained on the other end around a return of gear 10 mounted on an auxiliary frame 11 fixed to the housing. Cogged belt or gear belt 8 forms one of the output sides (for longitudinal movements) and gear belt 12 forms the other side (for transverse movements) of the coordinate control (to be described) of the work carrier 1.

To the upper section of each of cogged belts 8 and 12, a clutch mechanism generally designated 13 is firmly connected, operating as a drive means for transmitting the movements imparted to belts 8 and 12, to work carrier 1. Clutch mechanisms 13 are identical for both control output sides, therefore, only one such mechanism is described in the following:

A base plate 14 of clutch mechanism 13 is screwed to the associated gear belt 8 or 12. To the somewhat elevated free end 15 of base plate 14, channel section bearing part 16 is screwed having a recess 18 in its horizontal web 17, FIG. 3, in which a guide roller 21 is disposed close to the base plate. Guide roller 21 is mounted on a pivot pin or axle 20 which is passed through base plate 14 and secured thereto by a nut 19, and partly projects at the work carrier side from recess 18 to apply to one side 22 of a guide rail 23, 24 which is firmly connected to work carrier 1 by a spacer angle 25. A two-armed coupling lever 26 is pivoted to bearing part 16 by means of a horizontal pivot pin 27. One 28 of the lever arms of coupling lever 26 carries at its underside a back-up roller 29 which is mounted to arm 28 by means of a pivot pin 31 and secured by a nut 30. In the coupling position of lever 26, back-up roller 29 applies against the other side surface 32 of guide rail 23,24, opposite to surface 22, so that guide rail 23, 24 is received without play between rollers 21 and 29. To ensure a smooth motion of work carrier 1, the rollers may be embodied by roller bearings.

At the forked end of lever arm 33 of coupling lever 26, a two-armed crank lever 34 is mounted for pivoting about a pin 35. Lever arm 36 of lever 34 projects into a slot 37 of a link 39 which is mounted on bearing part 16 for pivoting about a pin 38 and is connected thereto by a pin 40. Crank lever 34 and link 39 form together a toggle joint.

Link 39 has a stop arm 41 with a stop surface 42 which, to limit the coupling motion of lever 36, butts against a stop surface 43 of coupling lever 26 under the action of a tension spring 44 which is engaged by its eyes 45 and 46 in circular grooves provided on the ends of pivot pins 27 and 40 protruding from one side of bearing part 16. Through the upwardly projecting lever arm 47 of lever 34, clutch mechanism 13 is actuated by a single-acting air cylinder 48 through a piston rod 49 and an actuating member 50 carried thereon, and against the action of a retaining spring 51. Each air cylinder 49 is supported on an angle support 52 which in turn is secured to a ledge strip 53 of a structure 55 carrying the individual embroidering heads 54 of the machine.

Air cylinders 48 are so arranged that in a certain position of the work carrier 1, lever arms 47 of the two clutch mechanisms 13 become vertically aligned with actuating members 50 of air cylinders 48.

Figure 4:
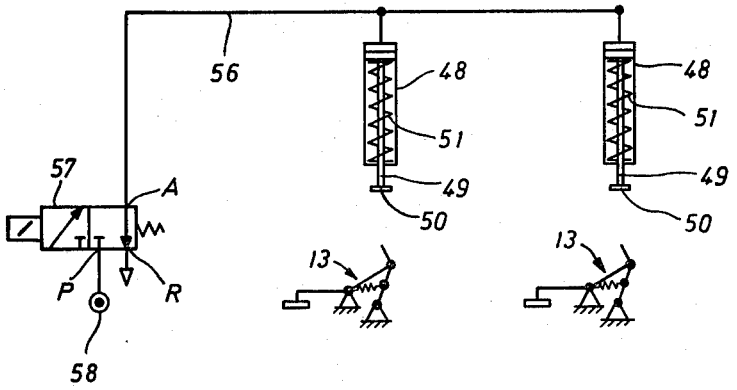
FIG. 4 is a schematic diagram of a compressed air circuit for controlling the diagrammatically indicated clutches.

Air cylinders 48 are connected to a common compressed-air line 56 and they are actuated by a switch-operated 3/2 solenoid valve 57 having its pump connection p connected to a compressed-air source 58 and its working connection A to compressed-air line 56. Venting is effected through R, FIG. 4.

Figure 3:
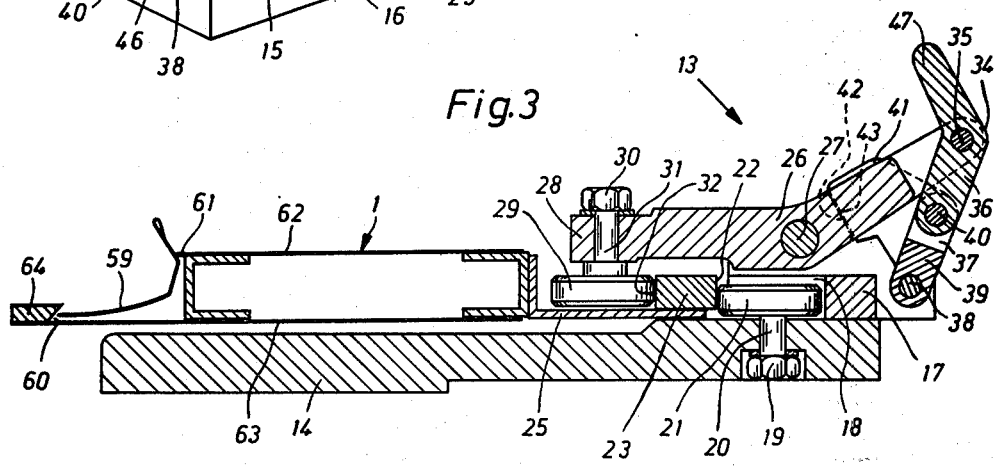
FIG. 3 is a sectional view taken along the line III—III of FIG. 2.

The work to be embroidered is clamped in carrier 1 by means of spring clamps 59, FIG. 3, which bear against a V-groove 60 by one of their ends, and from below against a projection 61 of a cover plate 62 of carrier 1 by their other end. V-groove 60 is formed by base plate 63 and a bevelled strip 64.

Figure 2:
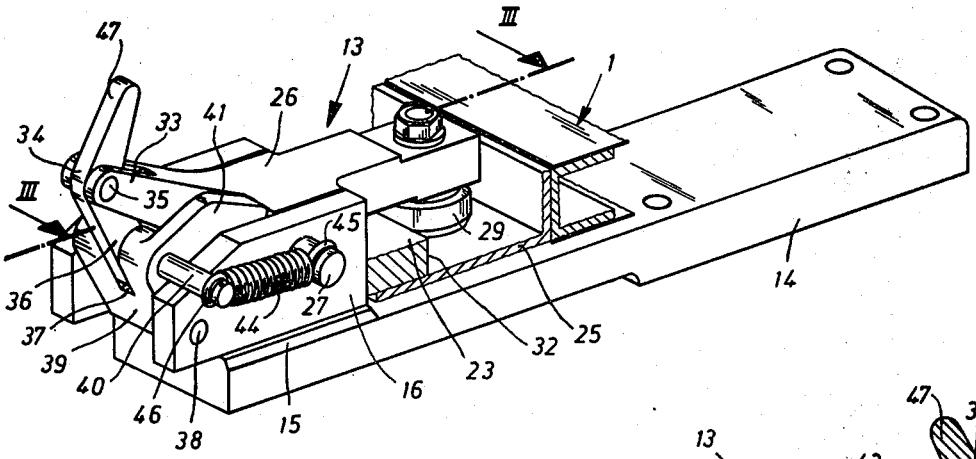
FIG. 2 is an enlarged perspective view of a drive member embodied by a clutch mechanism and associated with the output sides of the coordinate control device.

The equipment operates as follows:

Work carrier 1 in which the work to be embroidered is clamped by means of spring clamps 59 is coupled to the two output sides 8,12 of the coordinate control by clutch mechanism 13. By the two punched tape-controlled stepping motors 3,4 longitudinal and transverse movements (x,y FIG. 1) relative to embroidering heads 54 and corresponding to the desired embroidery pattern are imparted to carrier 1. At the end of one embroidering operation, i.e. in the charge position shown in FIG. 1 of carrier 1, the embroidering machine is stopped so as to have the needle bars of the embroidering heads in uppermost positions, with simultaneously the presser foots of embroidering heads 54 being lifted, and the threads being cut. In this position, lever arms 47 of crank levers 34 of both clutch mechanisms 13 are located in the range of motion of actuating members 50 of the respective associated air cylinders 48. Then, solenoid valve 57 is energized by switching on, so that the compressed air passes from pump connection P through working connection A and line 56 into air cylinders 48 to move piston rods 49 downwardly, against the action of springs 51. This makes actuating members 50 apply against lever arms 47 of crank levers 34, each arm 47 is pivoted counterclockwise, as viewed in FIG. 3, about pivot pin 35, whereby the toggle joint formed by lever arm 36 of crank lever 34 and link 39 folds inwardly to pivot coupling lever 26 clockwise, against the action of spring 44, so that back-up roller 29 is disengaged from guide rail 23, 24. Work carrier 1 is thus disengaged from the coordinate control device and can be removed and exchanged for another which is in standy position outside the machine. Now it suffices to place the new work carrier 1 with its side surfaces 24 and guide rails 23, 24 in contact with guide rollers 21 of clutch mechanisms 13, and the correct positioning is accomplished. To engage the new work carrier with the coordinate control device, solenoid valve 57 is switched off and brought by spring action into its rest position, so that air cylinders 48 are vented through R and their piston rods 49 are retracted by return springs 51, with actuating members 50 disengaging from crank levers 34. Then, tension springs 44 of mechanism 13 become effective to pivot coupling levers 26 back into their coupling position according to FIGS. 1 to 3, in which back-up rollers 29 apply against side surface 32 of guide rails 23,24. The closing motion of the coupling lever is limited by stop surfaces 42,43. This terminates the operation of changing work carriers 1. It is evident that this charge is very simple and can be effected in a very short time. The next embroidering operation may be started immediately after terminating the coupling operation.

While specific embodiments of the invention have been shown and described in detail to illustrate the application of the principles of the invention, it will be understood that the invention may be embodied otherwise without departing from such principles.

What is claimed is:

1. A workpiece moving device for an embroidering machine having at least one embroidering head, comprising a work carrier, at least one coordinate control mechanism connected to said work carrier for shifting said carrier along at least one coordinate backwardly and forwardly in respect to the embroidering head and in accordance with the embroidery pattern to be imparted to the workpiece, said control mechanism including a coordinate movement member movable along the coordinate and a clutch member connected to said member movable therewith, and engagement means associated with said clutch mechanism engageable with said work carrier upon actuation of said clutch mechanism to move said carrier with said coordinate movement member.

2. A workpiece moving device according to claim 1, wherein said clutch mechanism includes a support plate, a guide roller rotatably mounted on said support plate, said work carrier having a guide rail engageable against said guide roller and a clamping mechanism including a clamping member having a guide roller thereon and being clampable against the opposite side of said guide roller.

3. A workpiece moving device according to claim 1, including spring means urging said back-up roller against said guide rail, and an actuator engageable with said clamping member to disengage said back-up roller from the guide rail against the force of said spring.

4. A workpiece moving device according to claim 1, wherein said clutch mechanism includes a support plate, a guide roller rotatably mounted on said support plate, said carrier having a guide rail being engageable against said guide roller, a lever pivotally mounted on said support plate having a lever arm portion carrying a back-up roller and a second actuating arm portion, a toggle mechanism connected to said actuating arm portion and including an upper actuating arm, toggle mechanism actuating member disposed over said clutch mechanism and means for actuating said member to move it to engage said toggle mechanism to actuate said lever arm to engage said back-up roller against the guide rail in the opposite side from said guide roller.

5. A workpiece moving device according to claim 1, wherein said coupling mechanism includes a coupling lever and having a back-up roller which is engageable against said work carrier, a toggle lever connected to said coupling lever being pivotal to engage said coupling lever against said work carrier and stop means for limiting the movement of said coupling lever in respect to said work carrier.

6. A workpiece moving device according to claim 1, wherein said work carrier has a guide rail, said engagement means comprising a first roller engageable with one side of said guide rail, and a clamping arm member having a second roller engageable with the opposite side of said guide rail upon movement of said clamping member, and actuating means disposed in alignment with the path of movement of said clutch to actuate said lever arm member.

* * * * *